US005385207A

United States Patent [19]

Cook, Sr.

[11] Patent Number: 5,385,207

[45] Date of Patent: * Jan. 31, 1995

[54] OFFSHORE WELL REMOTE START-UP SYSTEM

[75] Inventor: Fred R. Cook, Sr., Pearl River, La.

[73] Assignee: Texaco, Inc., White Plains, N.Y.

[ * ] Notice: The portion of the term of this patent subsequent to Mar. 9, 2010 has been disclaimed.

[21] Appl. No.: 82,637

[22] Filed: Jun. 28, 1993

[51] Int. Cl.[6] ..... E71B 34/04

[52] U.S. Cl. ..... 166/363; 166/53; 137/624.18; 341/176

[58] Field of Search ..... 166/363, 53, 285, 321, 166/323, 382; 137/624.18; 74/128; 251/68; 341/176

[56] References Cited

U.S. PATENT DOCUMENTS 4,896,722 1/1990 Upchurch ..... 166/53 X 5,147,559 9/1992 Brophey et al. ..... 166/53 X 5,191,937 3/1993 Cook, Sr. ..... 166/363

*Primary Examiner*—William P. Neuder

*Attorney, Agent, or Firm*—Kenneth R. Priem; Robert B. Burns; Russell J. Egan

[57] ABSTRACT

System for remotely controlling the start-up of a closed-in well. A radio signal transmitted to the well actuates a main flow control valve to provisionally commence flow from the well into a conduit. During the provisional period, a comparator electronically analyzes the well's immediate operating pressure against a preferred operating parameter, and generates a signal representing the difference between the two. A generated signal further initiates such commands as will sustain well flow if the latter is within the preferred operating parameters, or after the brief provisional operating period, discontinues flow if necessary.

16 Claims, 3 Drawing Sheets 10
19
19a
20
21
22
23
24
27
28
33
34
36
38
41
42
43
44
46
47
48
48a
49
51
52
53
56
58
59
61
62
63
64
66
67
P/T
P/S
S

OFFSHORE WELL REMOTE START-UP SYSTEM

BACKGROUND OF THE INVENTION

1. Field of the Invention

During the production of hydrocarbons, such as crude oil and/or natural gas from a subterranean reservoir, it is necessary to closely regulate and control the flow of the well effluent. The latter normally is comprised of crude oil, water and gas in varying amounts. Close regulation of the well's operation is essential, not only to preserve the flow of product, but to do so in a manner to assure that the environment is protected and that the operation does not constitute a prospective safety hazard to personnel or to equipment.

Some offshore wells, when they reach the producing stage, are operated and controlled remotely. Such wells are provided with necessary control equipment in the form of valving, pressure regulators and the like, to maintain a controlled, orderly outflow of product. The system in one embodiment, includes the use of radio transmission between the well and the land-based control center. Each well can thereby be individually monitored and controlled as needed, either by an operator or automatically.

It can be appreciated that a reliable remote control feature is highly desirable in any offshore well. This feature is particularly true where a malfunction of the well or the wellhead can result in spillage of crude oil into the surrounding waters. Also, when weather conditions are such that well equipment might be damaged as by a hurricane, a storm, or the like, it is desirable to close the well in and permit it to remain idle until the weather crisis has subsided.

Toward promoting well safety, the U.S. Government (Minerals Management Office) has established procedures for recommencing flow, or opening a well to restore production after the well has been closed down under normal circumstances or even under an emergency situation. The mandated well start-up procedure takes into account that flow control or other equipment may have been damaged to the point where permitting the well to flow, could constitute a safety hazard to the environment, to equipment and personnel, or to all three.

With these concerns in mind, the Federal Regulation presently in effect requires that when a well is to be opened after a shutdown to allow flow to recommence, the presence of an operator on the well site is mandatory. The operator's primary function is to physically restart fluid flow. This regulation assumes that by manually opening the main flow control valve at the site, the operator has checked the well equipment to assure that it is in proper condition to assure safe continuation of the producing operation.

It can be appreciated that for a large number of individual offshore wells, each of which may be remotely controlled, manual restarting at the well site can be hazardous, time consuming, and an expensive phase of a producing operation. To obviate the need for personnel at the well site, the present system provides a method and apparatus for remotely reopening the well after a shut down under controlled or emergency conditions. It further incorporates a safety feature that automatically closes down the well after a brief reopened period should it be shown to be operating in a manner that causes the well flow line pressure to stabilize either below or above a predetermined acceptable range of operating pressures.

2. Discussion of the Prior Art

A well-control system similar to the one hereinafter disclosed, is taught in U.S. Pat. No. 5,191,937, which issued in the name of Fred R. Cook, Sr. on Mar. 9, 1993. The system includes a remotely actuated well-control system, wherein well operation is initially commenced and thereafter continued flowing or alternately closed down. The determining factor in the well's operating mode is established by monitoring the pressure generated downstream of the well, which in turn hydraulically actuates control elements to achieve an operating or non-operating mode.

As hereinafter discussed, the present invention addresses the problem of well start-up through use of an improved electronic pressure monitoring facility which provides a continuous yet accurate flow of data to assure continued safe operation of the well within preferred operating parameters.

SUMMARY OF THE INVENTION

To remotely reopen or to recommence flow from a previously closed down offshore well in a safe manner, the well is presumed to be provided with a main flow line, having a flow line valve which is subject to actuation whereby production flow through the valve and the flow line or conduit is controlled. The control system embodies means for remotely actuating the main flow control valve to open position to institute a provisional flow of the production fluid. The system further embodies a timer mechanism which is preset to a brief period of approximately two minutes or fraction thereof. During this time interval, flow line pressure will presumably stabilize to a value within a range of the desired operating pressures.

If at the end of the timed interval, flow line pressure fails to stabilize at an acceptable value within the prescribed operating range, a safety mechanism will automatically discontinue further production flow into the conduit by closing the main flow control valve.

To achieve the objectives of the invention, the apparatus and novel method includes providing a remotely actuated control system which comprises basically two circuits. Both circuits are concurrently functional to selectively communicate the main flow valve actuator to the flow line conduit. A safety circuit is interposed to override or to automatically close the well if necessary when an equipment or other malfunction is detected.

One circuit includes a flow line pressure sensing means which functions to assure production of fluid flow from the well only within the prescribed range of acceptable flow line pressures. The pressure sensing means is communicated with the main flow valve's actuator to discontinue flow through said main valve in the event that the flow line pressure does not stabilize to an acceptable value.

The other circuit includes a flow initiating valve means which is actuated to open position by a remotely transmitted radio signal. Timer means associated with said flow initiating valve, maintains communication between the flow line and the main valve actuator. After a preset operating period, it automatically disconnects said other circuit, thereby releasing the main valve to close only in the event the pressure sensing means indicates the flow line pressure outside of the prescribed operating pressure range.

Stated otherwise, the invention is addressed to a well control apparatus, which is responsive to receiving a remotely transmitted, wireless signal to commence fluid flow from a subterranean reservoir with which the well is communicated. The well is further connected with a conduit having a main flow control valve which is operable between open and closed positions to regulate fluid flow through the conduit.

A pressure sensing means detects conduit instantaneous pressure, which is in turn directed to a pressure discriminating valve. The latter functions to actuate the system's main control valve, thereby to initiate fluid flow into the conduit.

The apparatus further embodies the improvement of a first comparator means which receives data to electronically generate a first signal representative of any pressure differential which exists between the conduit instantaneous pressure, and a predetermined conduit operating pressure.

Valve means communicates said pressure sensing means with the pressure discriminating valve, which in turn functions to continue or to maintain the instantaneous conduit pressure thereby to sustain fluid flow into the conduit only when the comparator generated signal indicates that the conduit instantaneous pressure falls within the range of acceptable conduit operating pressure.

It is therefore an object of the invention to provide an offshore well control system that is capable of assuring safe start-up, or reopening of a closed well through the facility of a remotely transmitted signal.

DESCRIPTION OF THE INVENTION

Figure 1:
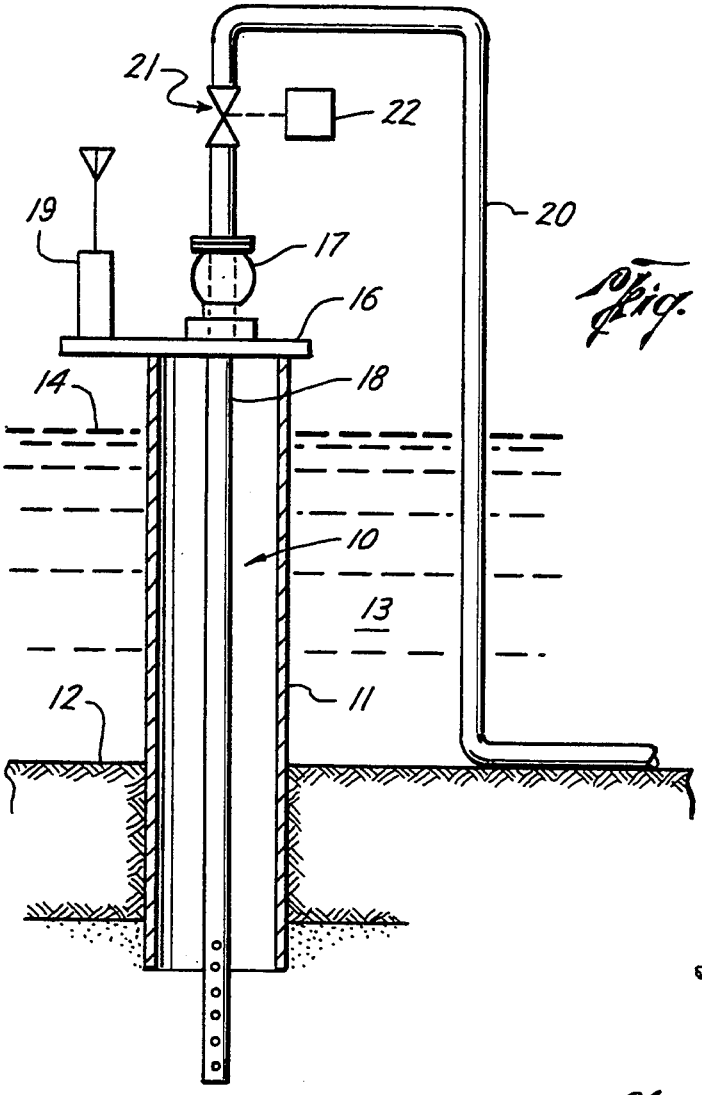
FIG. 1 is an environmental illustration of a well of the type contemplated.

FIG. 1 represents an embodiment of an offshore well 10 positioned such that a casing 11 is embedded into the ocean floor 12. Casing 11 extends through the body of water 13 to a point above the surface 14. Above the latter, the well is comprised of a support structure or platform 16 having a well head 17 which includes necessary flow control valving and pressure regulating members. Casing 11 supports platform 16 as well as wellhead 17, which maintains control over the production flow.

In the standard form of wellhead, the necessary valving is provided which will direct produced fluid including crude oil, water and gas, from a subterranean reservoir to a vessel positioned nearby or to a shore position. Preferably, production from a number of satellite wells is accumulated for further processing or pipelining to a processing point.

Wellhead 17 is communicated with a flow line 18 which extends downwardly through casing 11 and into a subterranean reservoir. Flow line 18 is perforated in the usual manner to allow ingress of production fluids from the surrounding substrate and is further provided with main flow control valve 21. Said valve is positioned upstream of a conduit or line 20 and functions between opened and closed positions as dictated by a main flow valve actuator 22.

It should be noted that the disclosed control system is comprised primarily of an electro-pneumatic combination in which the well's gaseous products function as the pneumatic medium. As a practical matter, the entire control system, referred to herein as the Remote Terminal Unit (RTU) 19 is enclosed within a protective casing on platform 16.

The upper end of well 10 as noted embodies a normal form of wellhead 17 having operating components, some of which function in response to manual manipulation operation or to a radio signal, or both. The signal is received by an antenna 19*a* from a shore-based or mother platform-based transmitter station not shown, but which is normally spaced miles away from the controlled well.

The shore-based or mother platform control or transmitting station is comprised primarily of a transmitter or transceiver, capable of broadcasting a predetermined frequency signal a sufficient distance to reach well 10 or wells being reopened, and received by appropriate receiving equipment, including antenna 19*a*.

Figure 2:
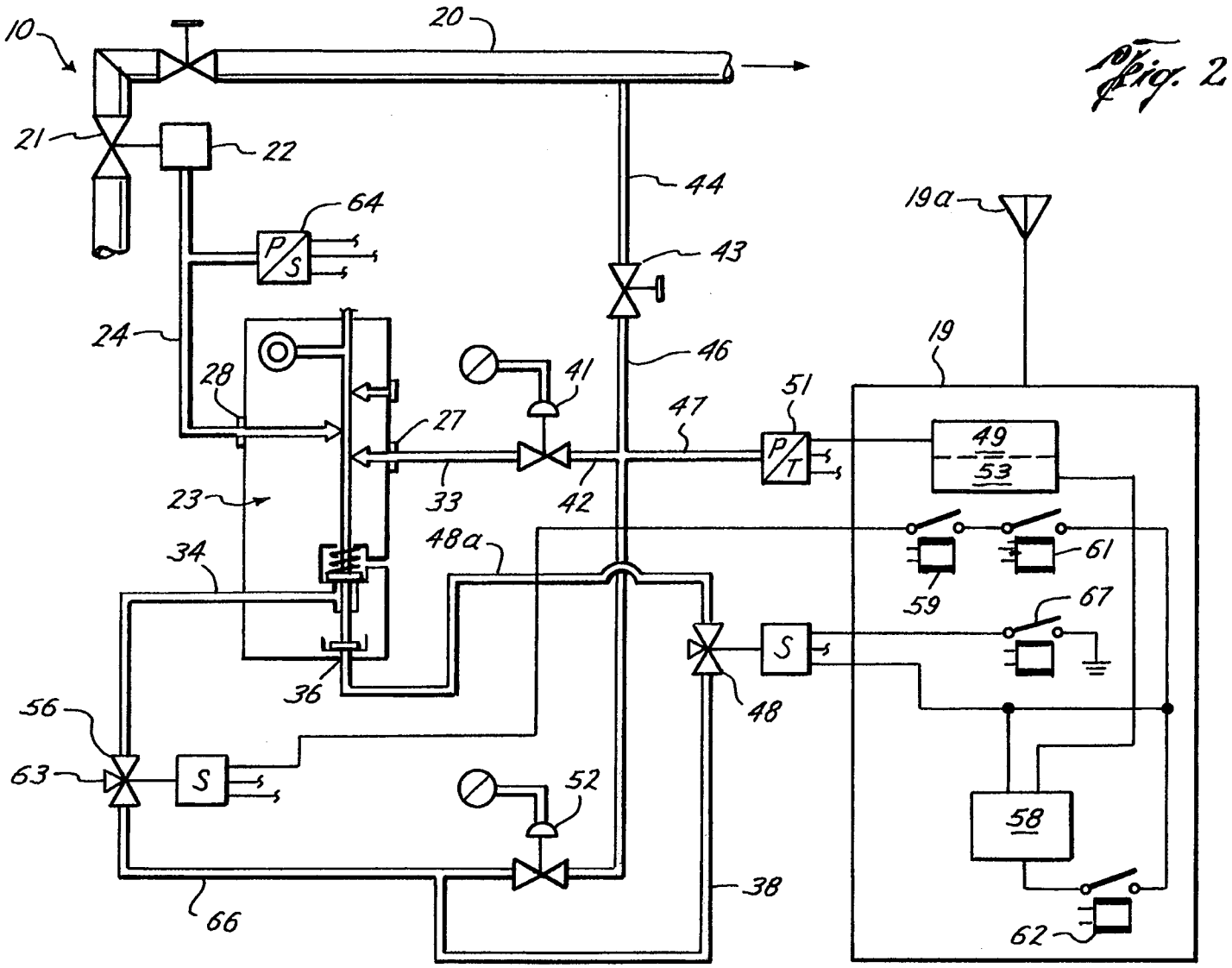
FIG. 2 is a schematic illustration of the well's control system.
Figure 4:
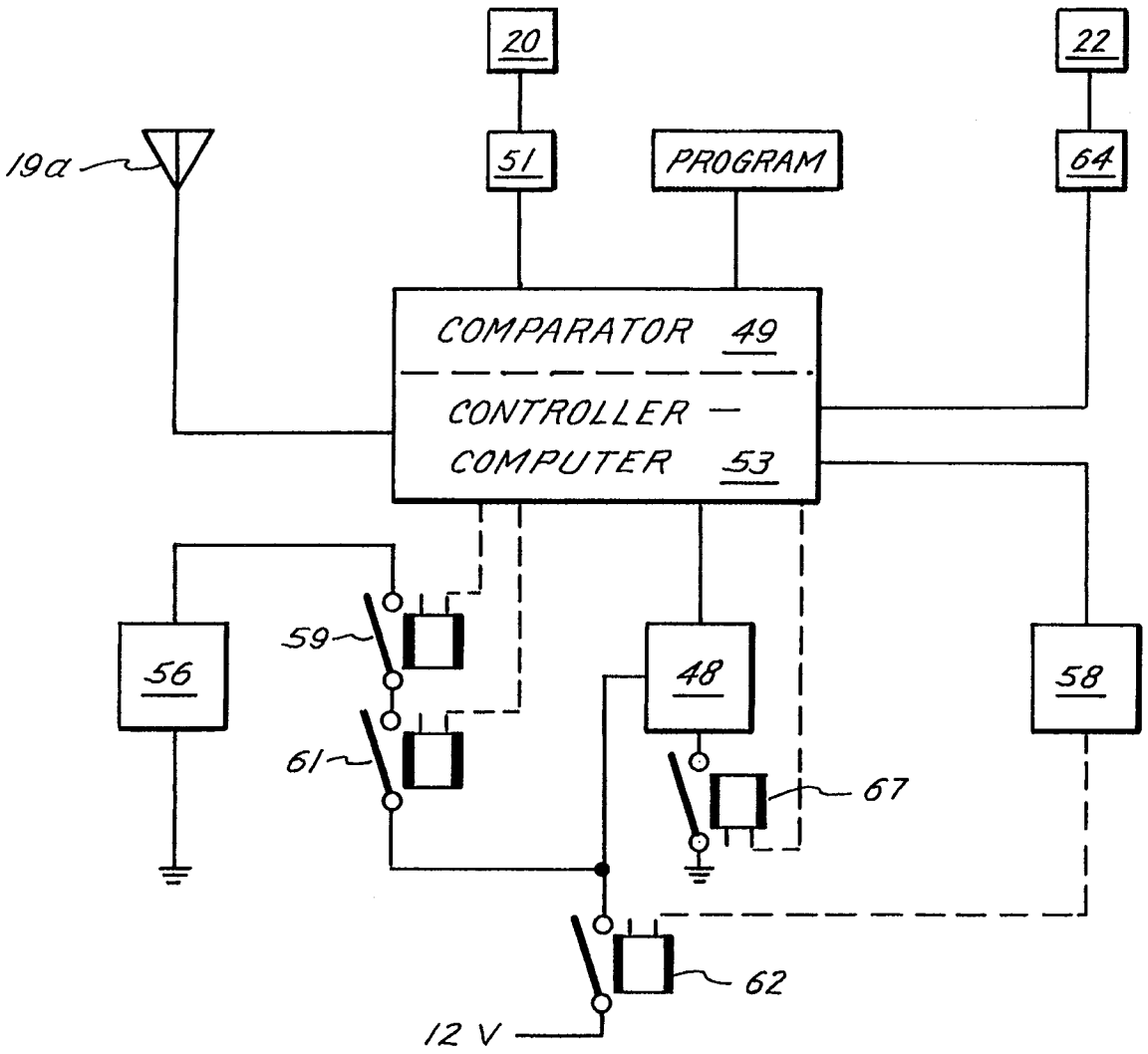
FIG. 4 is a block diagram of the disclosed system.

Referring to FIG. 2, at well 10 the control system is comprised of first or main control valve 21 which as noted, is positioned upstream of flow conduit 20 to regulate fluid flow from a subterranean reservoir, to wellhead 17 and thence into flowline 20. Valve 21 is operable to fully open or closed positions, being subject to adjustment by main valve actuator 22 to which it is connected.

Figure 3:
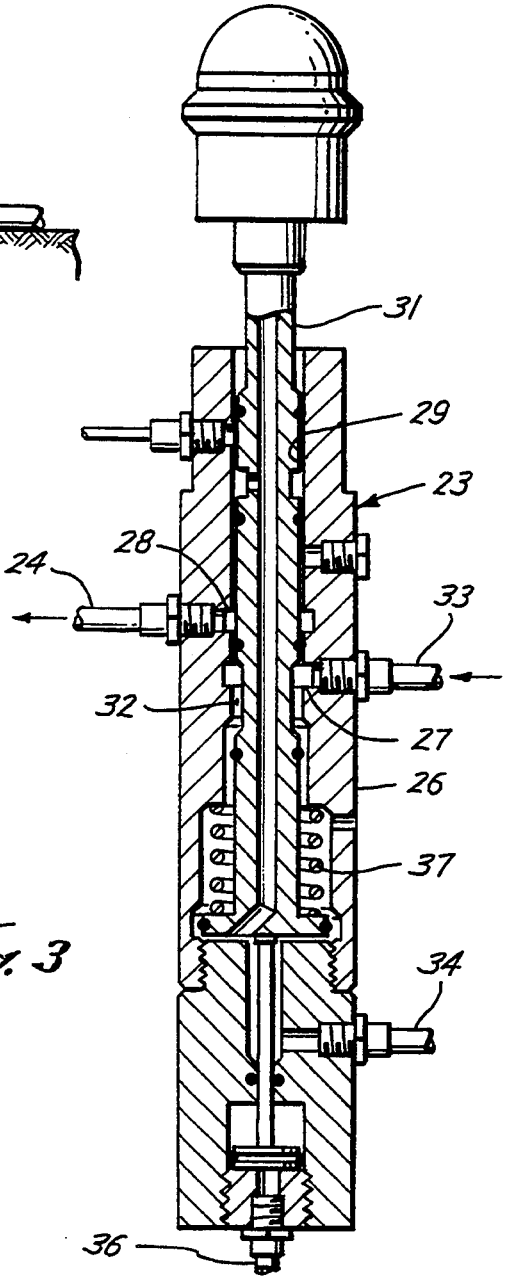
FIG. 3 is an enlarged segmentary section of one of the well's essential control features.

Referring again to FIGS. 2 and 3, valve actuator 22 is communicated to a second or pressure discriminator valve 23 by line 24 though which gas, as the actuating medium is conducted. Second valve 23 in one embodiment is comprised of a generally elongated body 26 having an inlet port 27 and an outlet port 28 which define the primary, interruptable flow paths of the system.

An axial passage 29 through elongated body 26 defines a cylindrical guide for a transfer plunger or valve operator 31. Plunger 31 comprises a piston-like member adapted for sealed, sliding longitudinal movement between forward and retracted positions. Said plunger can be longitudinally adjusted from the retracted to the forward position by pneumatic pressure or alternately, by manual manipulation.

Plunger 31 further includes spaced apart peripheral seals which slideably engage the contiguous cylindrical walls of passage 29 to form a dynamic, fluid tight engagement. Annular chamber 32, communicates inlet port 27 and outlet port 28, when plunger 31 is in it's advanced position, thereby allowing fluid pressure to be transmitted from line 33 to line 24 by way of chamber 32, and thence to main valve actuator 22.

The lower end of valve body 26 is provided with an inlet port 36 for receiving pressurized fluid to urge plunger 31 into its advanced or open position. Compression spring 37 retained within valve body 26 normally urges plunger 31 into its retracted or closed position to cause discontinuance of pressure communication through annular compartment 32, and thereby, to discontinue pressure against main valve actuator 22, a sequence that permits main valve 21 to close.

Line 33 is provided with a pressure regulator 41 which is communicated by lines 42 and 46 to flow conduit 20 through a connecting valve 43 and line or pressure sensing means 44. Functionally, when valve 43 is in open position, conduit 20 will be communicated directly by way of pressure regulator 41 to second valve 23. Pressure regulator 41 functions to limit or reduce pressure from conduit 20 acting against valve 23 to a preferred operating value not exceeding about 120 psi.

Conduit 20 is provided with a tap which accommodates pressure sensing means 44 having valve 43 at the downstream end thereof, which is communicated through line 46 and 47 to a pressure transducer 51. The latter monitors and registers the pressure in conduit 20, converts it into analog form and forwards this data to an electronic analog comparator 49. Said comparator is programmed to achieve a running comparison to establish differences that occur between conduit 20 instantaneous pressure, and the acceptable range of operating pressures at which conduit 20 must operate. Comparator 49 will generate a transmissible signal, and/or alternately, a digital reading to reflect the pressure differential.

Instantaneous pressure at 20 is transmitted from valve 43 to a second pressure regulator 52 in which the pressure is reduced to about 120 psi and directed through line 38 to first supplementary solenoid valve 48. From valve 48, the pressure is further directed through line 48*a* which then pressurizes the plunger 31 of valve 23 sufficiently to overcome the retarding force of spring 37 thereby urging plunger 31 into the advanced position, thus communicating line 33 with line 24.

Solenoid valve 48 is normally maintained in closed position, except for a preset brief time interval, when it is opened in response to a signal to allow initial opening of valve 23 by displacement of plunger 31. Solenoid valve 48 is thus interconnected electrically with a controller 53.

A second source of pressure, which is applied to valve 23 likewise originates at conduits 20 and is reduced to approximately 40 psi in regulator 52. Said pressure is then directed through a normally closed second supplementary solenoid valve 56 by way of line 66. With valve 56 in open position, pressure will be directed through line 34 to be applied against the lower side of plunger 31, thereby supplying a sufficient force to maintain plunger 31 in its advance or displaced position, whereby to communicate line 33 with line 24.

Functionally, the holding pressure transmitted by way of solenoid valve 56 to displace plunger 31 is sufficient to maintain the plunger in its displaced condition and allow flow through 23. Said pressure, however, is bypassed around plunger 31 in its retracted position; thus, 56 is effective only after plunger 31 has been initially moved to the advanced position by the action of valve 48. Since valve 48 is subject to the action of a timer 53 to relay 67, this valve will remain open to initially displace plunger 31 thus commencing the pressure flow into line 24 for a limited period as determined by the timer, which will cause 48 to close automatically at the end of the timed period.

If during the timed period, the signal produced by the comparator 49 does not indicate a favorable operating pressure in conduit 20, the holding pressure exerted on plunger 31 by way of valve 56 will not be maintained. After the set time period has elapsed, plunger 31 will be returned by spring 37 to its retracted position, thereby terminating further fluid flow through main valve 21.

From a safety consideration, timer 58 is connected electrically to controller 53. While pulse signals are received by timer 58, relay 62 is closed allowing voltage for solenoid valve 48 and relay 61. However, at such time as a malfunction in controller 53 or in the power system causes the fluid producing operation to cease, the computer generated signal conducted to timer 58 will cause the latter to open and remove supply voltage thereby automatically closing 23 to further actuation of valve 21. The latter will assume the closed or no flow position.

This is achieved by timer 58, which receives a pulsed signal from 53 at a uniform rate. When the signal is interrupted due to a malfunction in computer 53, closing of valve 23 will take place immediately. Similarly, since pressure sensing conductor 44 will be in a continuous detecting mode, the instantaneous pressure in conduit 20 will at all times be conducted through transducer 51 to comparator 49. Therefore, during any period of operation, should a malfunction in the equipment cause either an under pressuring or overpressuring at conduit 20, this condition will be analyzed in comparator 49 and computer 53 and the appropriate signal directed to valve 56, which will revert to the closed position.

Operationally, the primary feature of the disclosed system is to facilitate the reopening of one or more offshore or even onshore wells from a control or transmitting station which is remote from the wells. For purposes of discussion, the system, it will be assumed that the occurrences of storms, hurricanes, or even ordinary maintenance or other reasons has caused one or more of the wells to be shutdown to avoid the possible damage to equipments as well as to the environment.

In essence, to reactivate a closed in well or wells, the system provides that a radio transmission to one or more of the wells, fluid flow from the well to a fluid carrying conduit 20 will be provisionally commenced. If after a brief operation period of between 30 seconds and about 3 minutes, say for example 2 minutes, the conditions in conduit 20 indicate that the fluid flow conditions have stabilized and the operating pressure is within an acceptable range of operating pressures, the provisional condition will be overwritten and the well permitted to continue flowing.

If, however, during this provisional operating period the conditions in conduit 20 indicates a pressure either above or below the acceptable operating range this is an indication of possible equipment malfunction. The well will be automatically closed down to avoid further damage to equipment or to the well's surrounding environment as a result of accidental spillage.

Normal Well Operation

To facilitate the description of the starting or the reopening of a well, it is assumed that under normal operating conditions, main flow control valve 21 will be open, valve 23 will be open to allow flow from line 33 into line 28, valve 56 will be open and valve 48 will be closed. During the normal operating period, the pressure in 20 will be conducted by conductor 44, and this pressure applied to a pressure transducer 51. The latter in turn sends a data signal to comparator 49. The comparator will now run a continuous analytical comparison between the instantaneous pressure in conduit 20 and the conduit's acceptable operating pressure operating range. A generated signal to valve 56 will keep this valve open to sustain the fluid flow operation.

To close down a well whether under ordinary or emergency conditions, requires a signal to be sent from the remote transmitting station to the controller computer 53 which in turn forwards the necessary command to valve 56 to close. Loss of pressure from valve 56 by way of vent port 63 will cause valve 23 to immediately close, which further closes valve 21, thereby terminating fluid flow into conduit 20.

Reopening A Well

For a well reopening procedure, a radio signal is sent from the remote transmitting station to RTU 19 and is received by antenna 19*a* at computer 53. The computer will forward an activating command to normally closed valve 48 which in response to said command will open. Residual pressure normally present in conduit 20 will be transmitted through pressure conductor 44 and valve 43, to pressure regulator 52. This pressure at about 120 psi will then be transmitted by way of line 38 and open valve 48, through line 49 to displace plunger 31 to its advanced position. Opening of the latter will cause pressure at regulator 41 to be transmitted by line 33, valve 23 and line 24 to valve actuator 22. The latter will cause main flow control valve 21 to open, thereby commencing fluid flow into conduit 20.

With the opening of valve 48 for a limited, preset timed period, the system will be activated. Valve 48 will be sustained in open position only for about 2 minutes, during which period fluid flow in conduit 20 will continue toward stabilization.

During this provisional operating period, conditions in conduit 20 may tend to be unstable and could remain so for duration as the timed period. If all the equipment, however, is in proper operating order, the conduit 20 condition will normally settle to a constant measurable pressure. During this period, pressure in conduit 20 is monitored by pressure transducer 51 and resulting data is fed to the comparator 49. The latter, which as noted, has been programmed to compare incoming fresh data will analyze the data.

Comparator 49, upon analyzing the incoming data, will generate a signal indicating either of two prevailing conditions. Under favorable conditions, and with the pressure in conduit 20 stabilized at the acceptable pressure level, controller 53 will send a command to valve 56 to remain open. At the end of the provisional two minute period, valve 48 will automatically close thereby discontinuing that segment of pressure on plunger 31 which is conducted by way of line 49.

This reduction of the plunger 31 displacing pressure will not affect its advanced position, since the pressure from valve 56 maintaining plunger 31 displaced, will sustain valve 23 in the open condition.

During this provisional period, should non-stabilized conditions in conduit 20 indicate an instantaneous pressure either above or below the accepted range of operating pressure, this data will be transmitted by conductor 44 and valve 43 to pressure transducer 51. The data, when fed to comparator 49, will cause the latter to generate a command to valve 56 causing the latter to close. The effect of this sequence of events will be that all pressure previously applied to plunger 31 by holding valve 56, and closing of valve 48, will be discontinued. Plunger 31 will be urged by spring 37 into its retracted position resulting in no pressure being transferred through said valve 23 to the valve actuator 22.

Should it be determined after an on site inspection by personnel that the disclosed well control system is not workable or defective, flow to conduit 20 can be commenced by physically opening valve 23 to its advanced position and commencing operation of controller 53. Thereafter, with the well control system normally operating, even though valve 23 has been opened manually, the system will continue to function under control at the controller 53.

As a further safety factor the system, will function to close down the entire well flowing operation in the event that computer 53 becomes inoperable due to loss of power at anytime, or for other reasons. This is achieved by way of the timer 58 which will receive a periodic pulsed signal in response to computer operation. In the event the received signal is not read by 58, the supply relay 62 will open to automatically discontinue pressure to valve 23. Plunger 31 will retract to close main flow valve 21 and consequentially the passage of further fluid into conduit 20.

What is claimed is:

1. Well control apparatus responsive to receiving a remotely transmitted radio signal to commence flow of fluid from a previously closed-in well, into a conduit 20 wherein said conduit has a main flow control valve 21 operable between open and closed positions to regulate fluid flow through said conduit, pressure sensing means 44 for detecting instantaneous pressure in said conduit, and a pressure discriminator valve communicated with said conduit 20 for opening said main flow control valve to initiate fluid flow into said conduit, the improvement in said apparatus comprising, comparator means 49 for electronically generating a first signal representative of the pressure differential between an instantaneous conduit pressure, and a predetermined range of acceptable conduit operating pressure, and valve means communicating said pressure-sensing means with said pressure discriminator valve for continuing said instantaneous conduit pressure whereby to sustain fluid flow into the conduit when said first signal indicates that the conduct instantaneous pressure falls within the range of the acceptable conduit operating pressures.

2. In the apparatus as defined in claim 1, wherein said pressure discriminator valve 23 includes a pressure sensitive operator 31 which is adjustable between upper advanced and retarded positions, and means communicating said pressure sensitive operator with at least two remotely activated flow control members communicated with said conduit for applying sufficient pressure to the operator to said advanced position.

3. In the apparatus as defined in claim 2, wherein said at least two remotely activated flow control member includes first and second supplementary valves, communicating said conduit with said operator for concurrently applying sufficient pressure to the operator to retain the latter in said advanced position.

4. In the apparatus as defined in claim 2, including means for remotely discontinuing the application of pressure to said operator to allow the operator to adjust to its retracted position.

5. In the apparatus as defined in claim 2, including biasing means in said pressure discriminator valve for normally urging said operator into the retracted position.

6. In the apparatus as defined in claim 2, including spring means engaging said operator for normally urging the operator into retracted position.

7. In the apparatus as defined in claim 3, wherein said first and second supplementary valves respectively are communicated with said pressure discriminator valve through pressure regulating means for applying pressures to said operator less than said conduit instantaneous pressure.

8. In the apparatus as defined in claim 1, including a timer means associated with said valve means for sustaining fluid flow into said conduit for a limited time period, regardless of the indication of said comparator generated first signal.

9. In the apparatus as defined in claim 7 wherein said first supplementary valve includes a pressure regulator which applies the pressure to said valve operator of sufficient magnitude to displace and to maintain the discriminator valve operator in its advanced position.

10. In the apparatus as defined in claim 7 wherein said second supplementary valve includes a pressure regulator which applies a pressure of sufficient magnitude to maintain said operator in the advanced position, but of insufficient magnitude to displace the operator from its retracted position to the advanced position.

11. In the apparatus as defined in claim 8 wherein said timer means includes means for adjusting the timer interval.

12. In the apparatus as defined in claim 1 wherein said comparator means is a computer.

13. In the apparatus as defined in claim 1 wherein said comparator means includes means for comparing instantaneous conduit pressure with an accepted range of acceptable conduit operating pressures on a continuous basis.

14. A method for remotely recommencing fluid flow from a closed down well having a main flow control valve for regulating said fluid flow, into a conduit, which method includes the steps of:

activating said main flow control valve to provisionally initiate fluid flow from the well into said conduit during timed interval, electronically comparing instantaneous pressure in said conduit, with a predetermined range of conduit operating pressures;

generating an electronic signal which is reflective of the difference between the conduit instantaneous pressure, and a predetermined range of conduit operating pressures; and using said generated signal to effectuate the operational status of the well at the termination of said timed interval.

15. In the method as defined in claim 14, including the step of:

deactivating said main flow control valve to shut off fluid flow to the conduit when said generated signal indicates a conduit instantaneous pressure which is not within the range of said predetermined conduit operating pressures.

16. In the method as defined in claim 14 wherein said electronic comparison between the conduit instantaneous pressure and the preferred range of conduit operating pressures, is made on a continuous basis.

* * * * *